US005803446A

United States Patent [19]

Leuthold et al.

[11] Patent Number: 5,803,446

[45] Date of Patent: Sep. 8, 1998

[54] METHOD AND APPARATUS FOR SINGLING LOOSE SHEET MATERIAL

[75] Inventors: Karl Leuthold, Munich; Karl Benker, Moosburg; Wolfgang König, Munich; Erwin Demmeler, Memmingen; Josef Geier, Munich, all of Germany

[73] Assignee: Giesecke & Devrient GmbH, Munich, Germany

[21] Appl. No.: 750,209

[22] PCT Filed: Apr. 3, 1996

[86] PCT No.: PCT/EP96/01468

§ 371 Date: Apr. 24, 1997

§ 102(e) Date: Apr. 24, 1997

[87] PCT Pub. No.: WO96/31423

PCT Pub. Date: Oct. 10, 1996

[30] Foreign Application Priority Data

Apr. 4, 1995 [DE] Germany ..... 195 12 505.3

[51] Int. Cl.[6] ..... B65H 3/44; B65H 5/26

[52] U.S. Cl. ..... 271/9.08; 271/9.01; 271/159; 414/795.8; 414/796.7

[58] Field of Search ..... 271/9.08, 9.01, 271/158, 159, 157, 147; 414/795.8, 796.7

[56] References Cited

U.S. PATENT DOCUMENTS

| | | | |
|---|---|---|---|
| 2,690,337 | 9/1954 | Halahan et al. | 271/159 |
| 3,180,638 | 4/1965 | Meylan | 271/159 |
| 4,174,831 | 11/1979 | Marass et al. | 271/159 |
| 4,390,175 | 6/1983 | Takahashi | 271/155 |
| 4,703,924 | 11/1987 | Marass | 271/158 |
| 4,988,263 | 1/1991 | Odenthal | 414/796.7 |
| 5,011,126 | 4/1991 | Suzuki et al. | 271/159 |
| 5,529,456 | 6/1996 | Luxem et al. | 271/158 |

FOREIGN PATENT DOCUMENTS

| | | | |
|---|---|---|---|
| 0 535 361 A2 | 4/1993 | European Pat. Off. . | |
| 0 604 770 A1 | 7/1994 | European Pat. Off. . | |
| 2637086 | 12/1977 | Germany | 271/159 |
| 3941 993 C1 | 1/1991 | Germany . | |
| 38-0001013 | 2/1963 | Japan | 414/796.7 |

*Primary Examiner*—H. Grant Skaggs
*Attorney, Agent, or Firm*—Bacon & Thomas PLLC

[57] ABSTRACT

A method for singling loose sheet material, in particular bank notes, wherein the sheet material is supplied in an input pocket in the form of a stack in a defined position for vertical feed of the sheet material to a singler. The sheet material is moved within the input pocket vertically from the feed position to a singling position. While the preceding stack is still being singled in the singler, the next stack to be singled is already supplied in the input pocket of the singler in the defined feed position.

17 Claims, 9 Drawing Sheets

METHOD AND APPARATUS FOR SINGLING LOOSE SHEET MATERIAL

Figure 1:
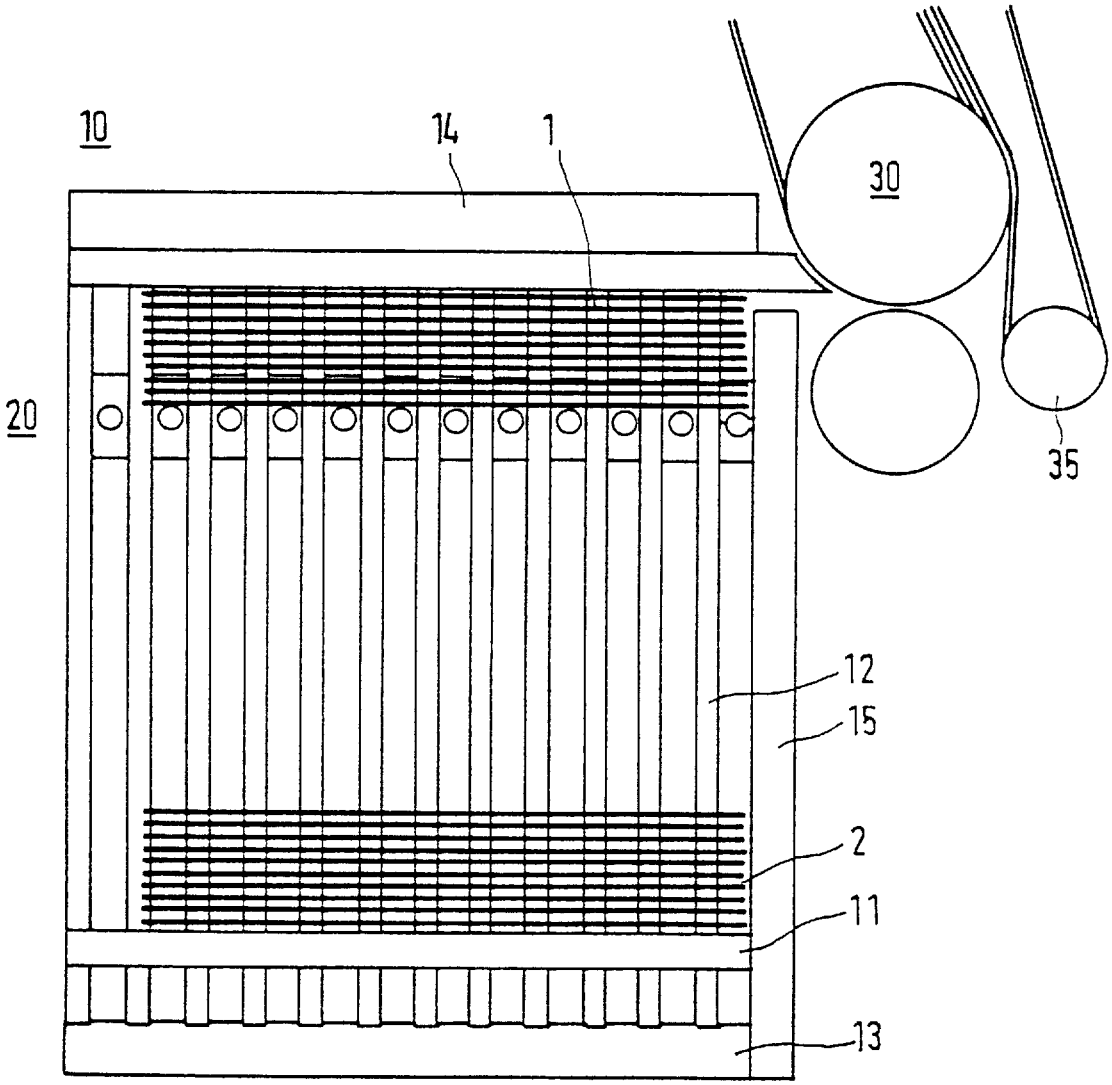

This invention relates to a method for singling loose sheet material, in particular bank notes, wherein the sheet material is supplied in an input pocket in the form of a stack in a defined position for vertical feed of the sheet material to a singler. The sheet material is moved within the input pocket vertically from the feed position to a singling position and singled. The invention further relates to an apparatus for singling loose sheet material.

A method and apparatus of the abovementioned type is known for example from EP 0 185 395 B1. In the known method a stack of sheets is transported to the singling apparatus by a stack transport system when the last sheet of the preceding stack has been singled. As soon as the last sheet of a stack has been singled the transport system is activated to supply a further stack. As soon as the stack of sheets is located on a stack table with its leading edge in a defined position for vertical feed of the sheets, the singling run is started.

The known method has the disadvantage that one can only start supplying the next stack of sheets to be singled on the stack table when the last sheet of the preceding stack has left the singling apparatus. One must accordingly interrupt singling to supply a new stack, which proves disadvantageous in particular when singling large piece numbers. Although it is already proposed in the known method to reduce gaps in the singling run by supplying the next stack of sheets to be singled as quickly as possible, this solution is unsatisfactory since the quick transport of a stack of sheets can cause a shift in individual sheets, which can complicate the positioning and thus the singling of the stack of sheets.

The invention is based on the problem of providing a method for singling loose sheet material which permits a higher throughput with no disturbances in the run of a singling apparatus.

This problem is solved by the features stated in the characterizing parts of the independent claims.

The basic idea of the invention is that the next stack to be singled is supplied in the input pocket of the singler in a defined position while the preceding stack is still being singled in the singler. This improves the throughput since the singling run need not be interrupted for supplying the next stack to be singled. Since the next stack to be singled is supplied in overlap with the singling of the preceding stack, there is enough time for proper exact positioning of the stack in the input pocket of the singler. This makes it possible for example to avoid malfunctions in the singling run due to an improperly positioned stack, thereby improving the reliability.

According to a development of the invention, the stack of sheets already being processed in the singler can be brought together in the singling apparatus with the next stack to be singled, resulting in a continuous flow of sheet material within the input pocket of the singler. This has in particular the advantage that the continuous feed of sheet material within the singler permits the singling run to be performed without interruption. This improves the throughput rate further, making the invention excellently suited in particular for high-speed sorting machines to which the sheet material is fed in loose form.

For example the invention can be used for testing fresh printed bank notes or for testing the condition of used bank notes, which are supplied in loose form in the input pockets of the singler in each case. One can combine a plurality of stacks of fresh printed or used bank notes into one accounting unit which is then distributed over a plurality of input pockets. The last sheet of the accounting unit can for example be recognized automatically by a reflected light barrier of the singler.

In a preferred development, the input pockets are of transportable design and can be filled with sheet material at a loading position and transported to one or more singlers. For transporting the input pockets one provides a suitable transport system which can include one or more transport paths which can be interconnected. In the transport path one can arrange a plurality of input pockets in tandem so that the transport path has a storage function.

The input pockets can be filled with sheet material manually or else automatically with the help of robots. In the latter case the filling and transport of the input pockets and the singling are controlled automatically from a central control station. This central control station or computer can for example also perform the logging for the individual accounting units, e.g. for one shift, whereby the operator can at any time obtain information from the log about whether an accounting unit has been processed properly.

The invention also relates to an apparatus for singling loose sheet material, in particular bank notes, having an input pocket for the sheet material supplied in the form of a stack and means for feeding the sheet material disposed on a rest of the input pocket to a device which singles the stack sheet for sheet out of the input pocket.

The apparatus is characterized in that the sheet feeding means are formed in such a way as to be movable vertically and horizontally inside and outside the input pocket relative to the input pocket. The sheet feeding means include for example at least one rakelike gripper having a protruding area which cooperates with the retaining wall of the input pocket in such a way as to prevent a sheet from sliding through between the retaining wall and the protruding area of the gripper.

In a development, the protruding area of the gripper can also be of rotatable design. The rest of the input pocket can also be vertically adjustable, which is advantageous in particular when different stack sizes are to be processed. This permits for example the size of the input pocket to be adapted optimally to the stack size, which reduces the time required for returning the gripper located in the singling position to the feed position located below the rest, thus also increasing the throughput.

For feeding the sheet material to the singler one can also provide two rakelike grippers each movable vertically and horizontally, which cooperate in such a way as to obtain a continuous feed of sheet material to the singling device within the input pocket. The use of two independently movable grippers permits a continuous flow of sheet material in the singler, so that no interruption of singling is necessary for supplying the sheet material during the processing of an accounting unit.

In a development, the feeding means, in particular the rakelike grippers, are each rotatably mounted so that the first gripper located for example in the singling position is rotated by the second gripper moved vertically out of the feed position and is operated electromechanically in such a way that the feed motion of the second gripper is stopped and the gripper located in the singling position moved out of the input pocket. The rotatable design of the grippers has the advantage that proper automatic feed of the sheet material is guaranteed independently of the particular stack height. For detecting the rotation each gripper is provided with suitable microswitches which provide corresponding signals to a control unit. The control unit then controls the motion pattern of the grippers with reference to the signals in such a way as to produce a continuous feed of sheet material in the singling apparatus.

The input pocket provided in the singling apparatus includes at least a rest and a retaining wall for the sheet material to be singled. Additionally one can provide a side wall which, like the rest, is formed for example by parallel rods.

According to a development, the input pocket can consist of two parts, the upper part being stationary in the singling apparatus and the lower part being of transportable design to be transported with the help of a transport system from the loading position for filling the input pocket to the singler or a plurality of singlers. For marking the last input pocket belonging to an accounting unit, the transportable lower part of the input pocket can be provided with a suitable mechanical flag whose electromechanical operation is evaluated accordingly by a control unit.

Figure 2A:
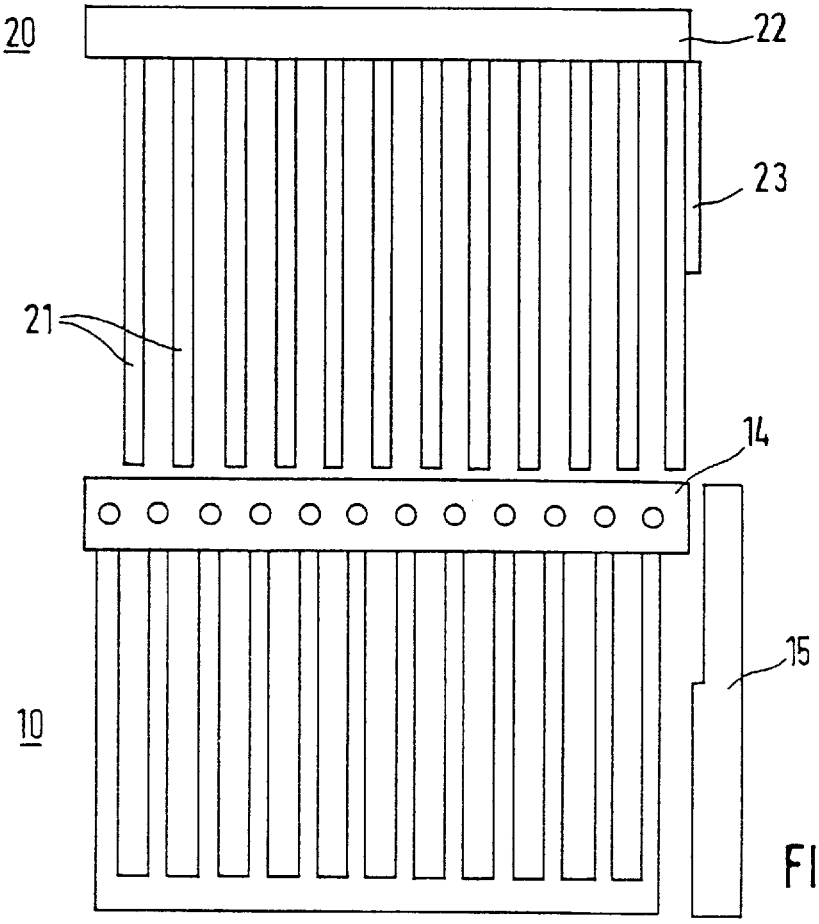
Figure 2B:
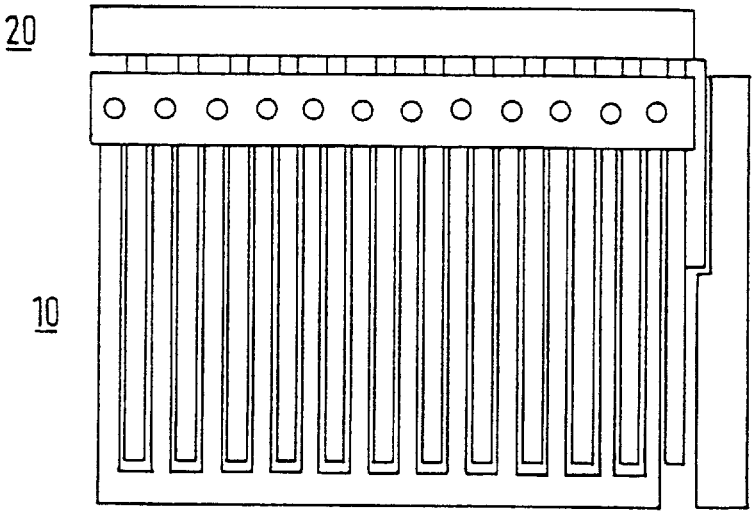
Figure 3A:
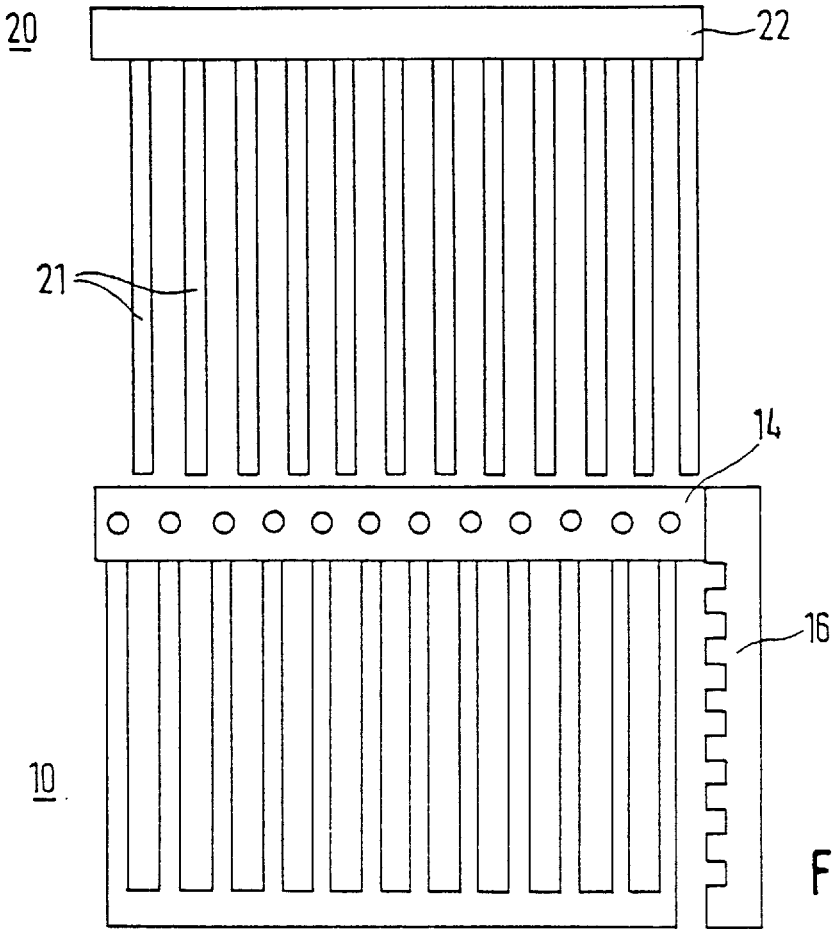
Figure 3B:
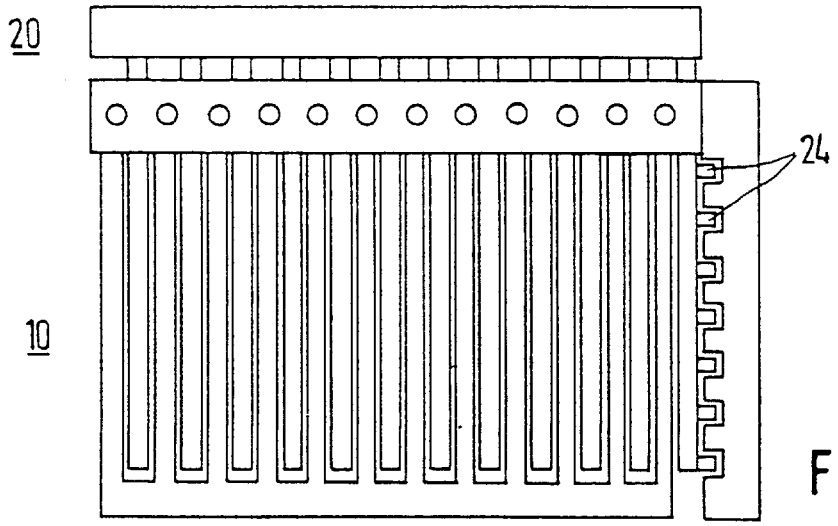
Figure 4A:
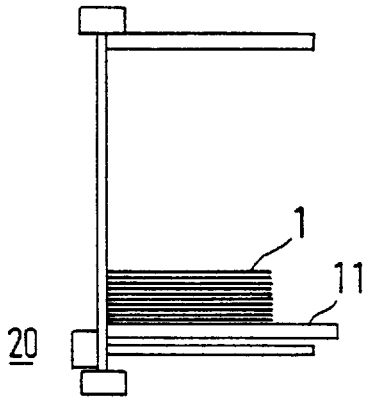
Figure 4B:
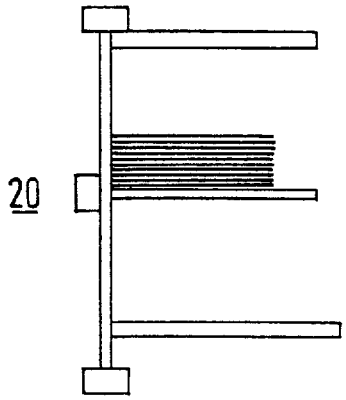
Figure 4C:
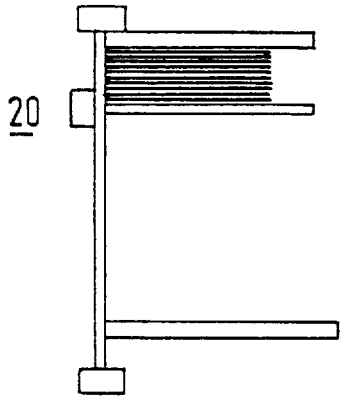
Figure 4D:
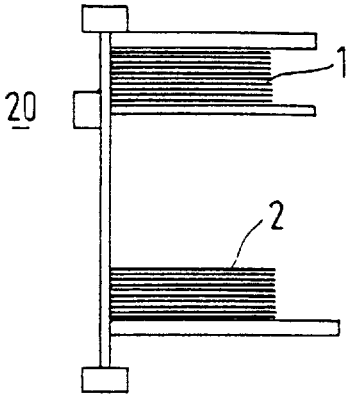
Figure 4E:
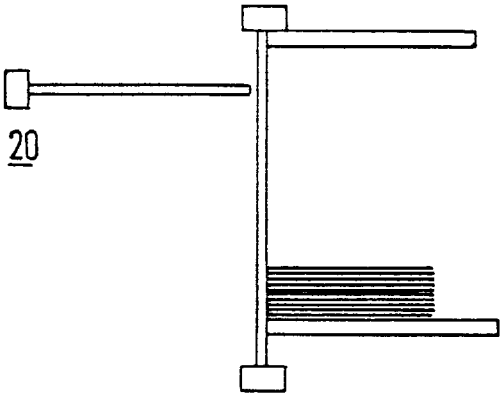
Figure 4F:
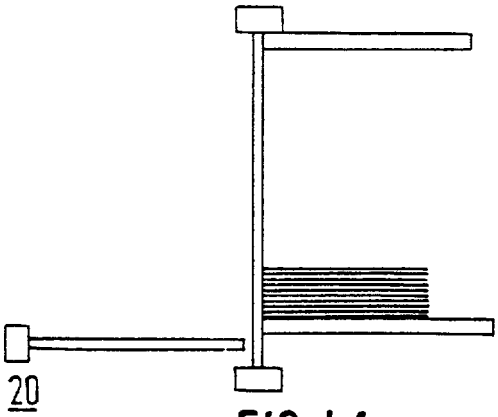
Figure 5A:
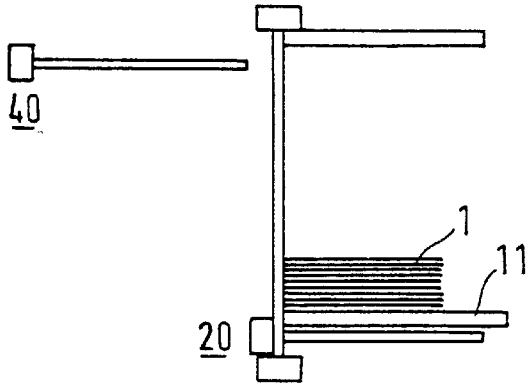
Figure 5B:
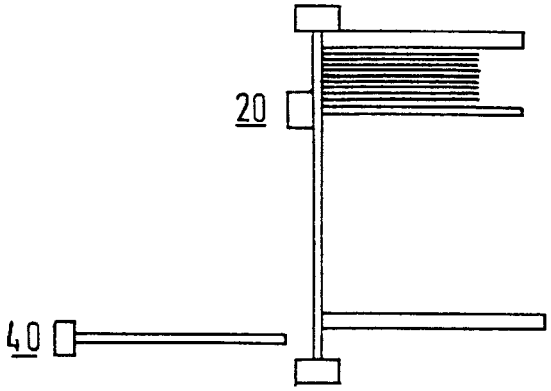
Figure 5C:
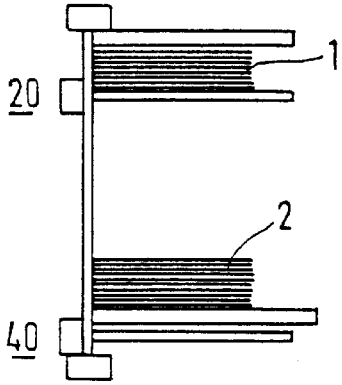
Figure 5D:
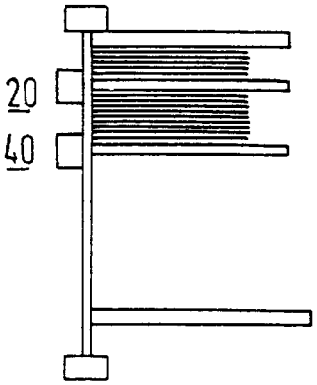
Figure 5E:
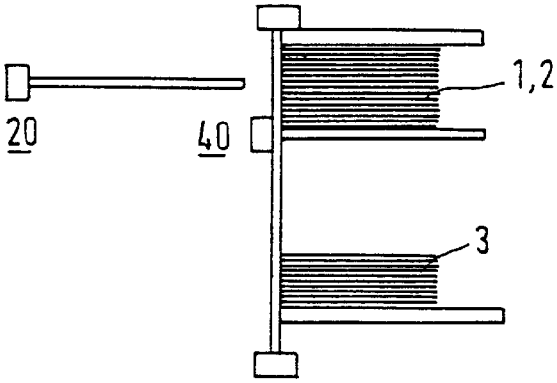
Figure 5F:
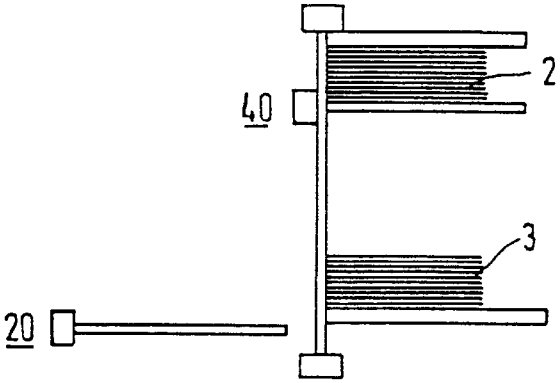
Figure 6B:
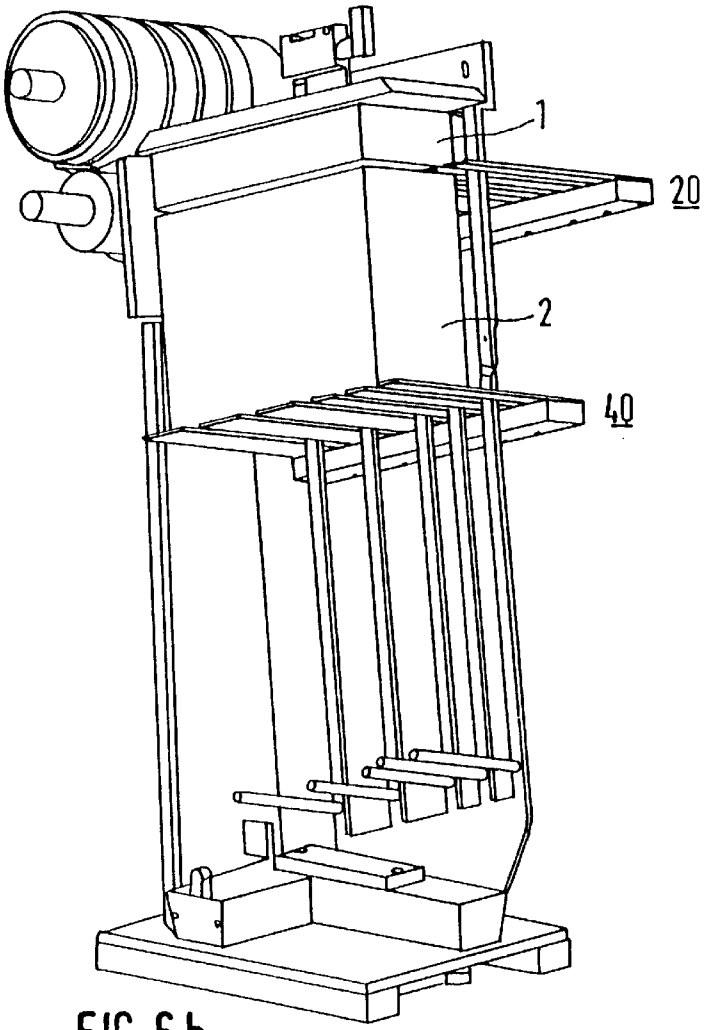
Figure 6A:
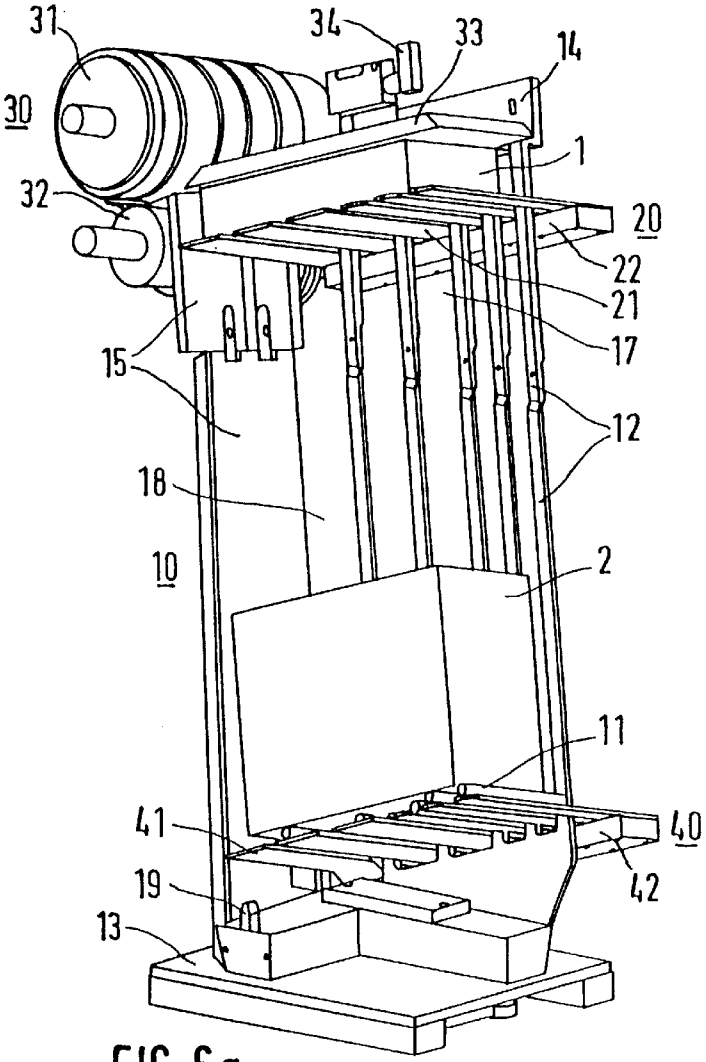
Figure 7:
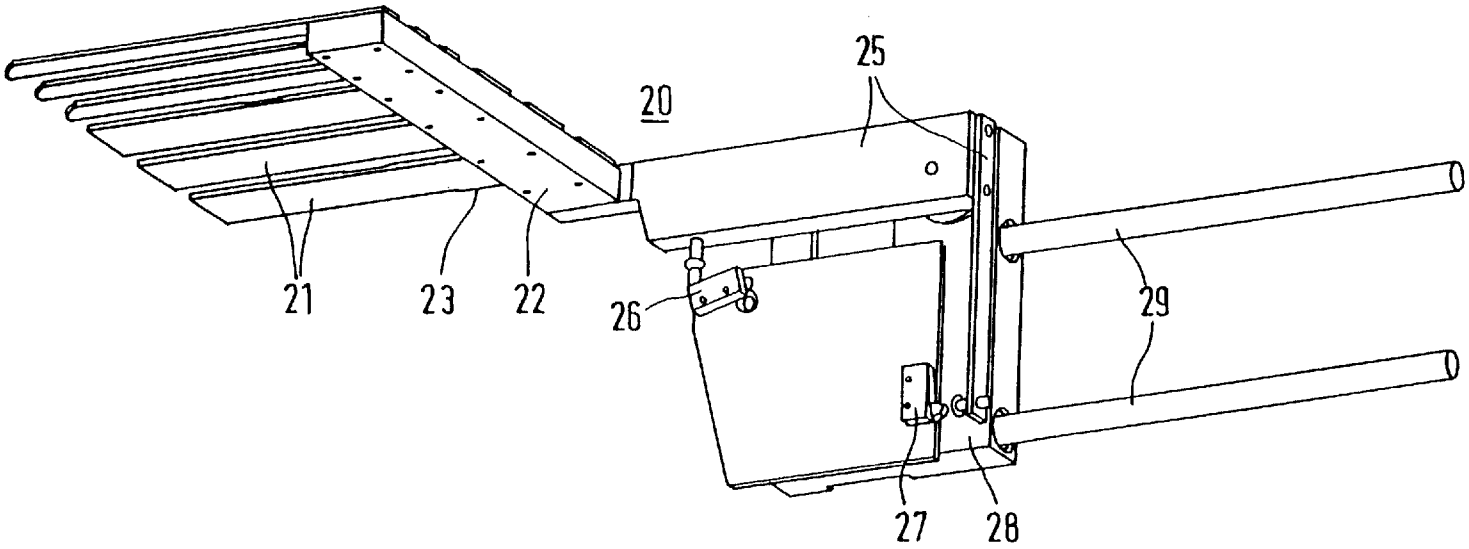
Figure 7A:
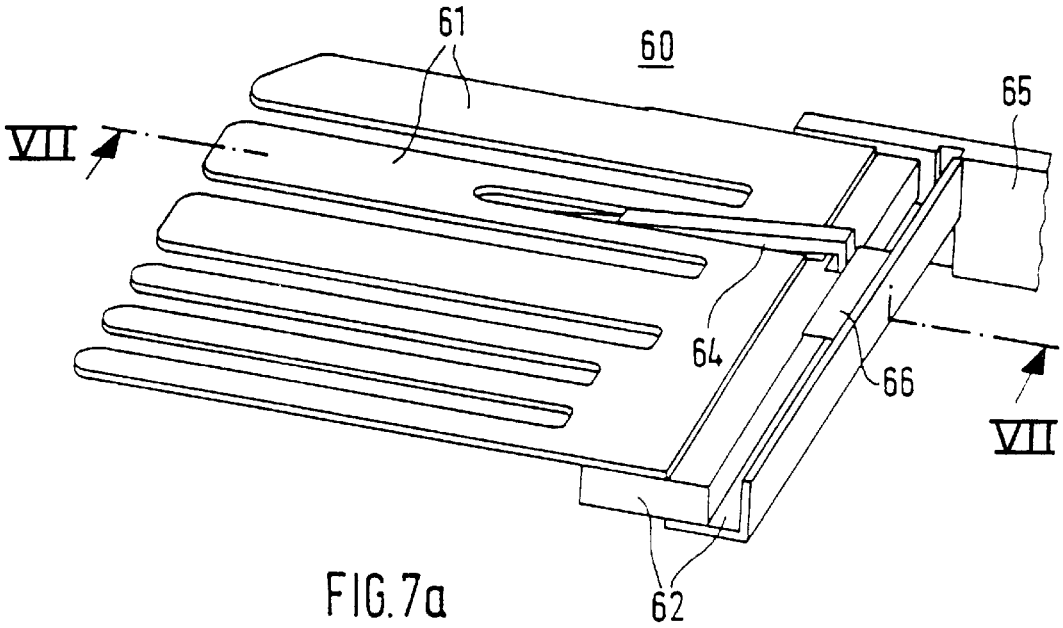
Figure 7B:
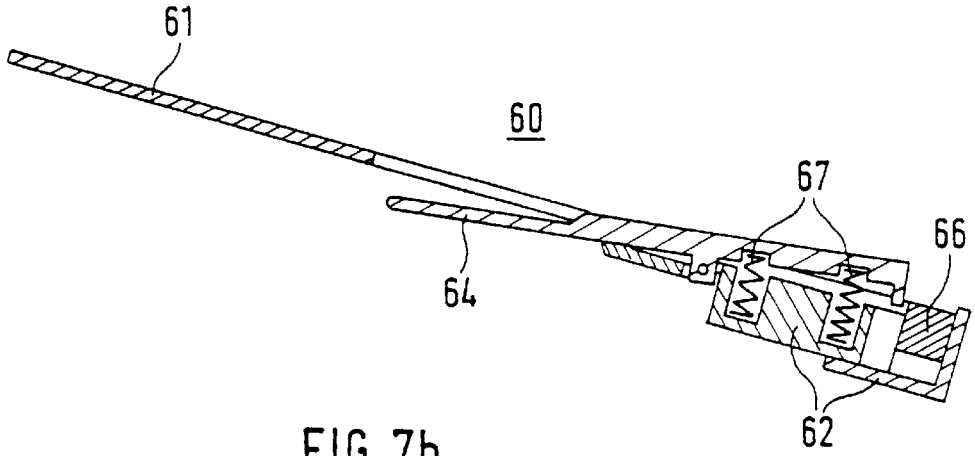
Figure 8:
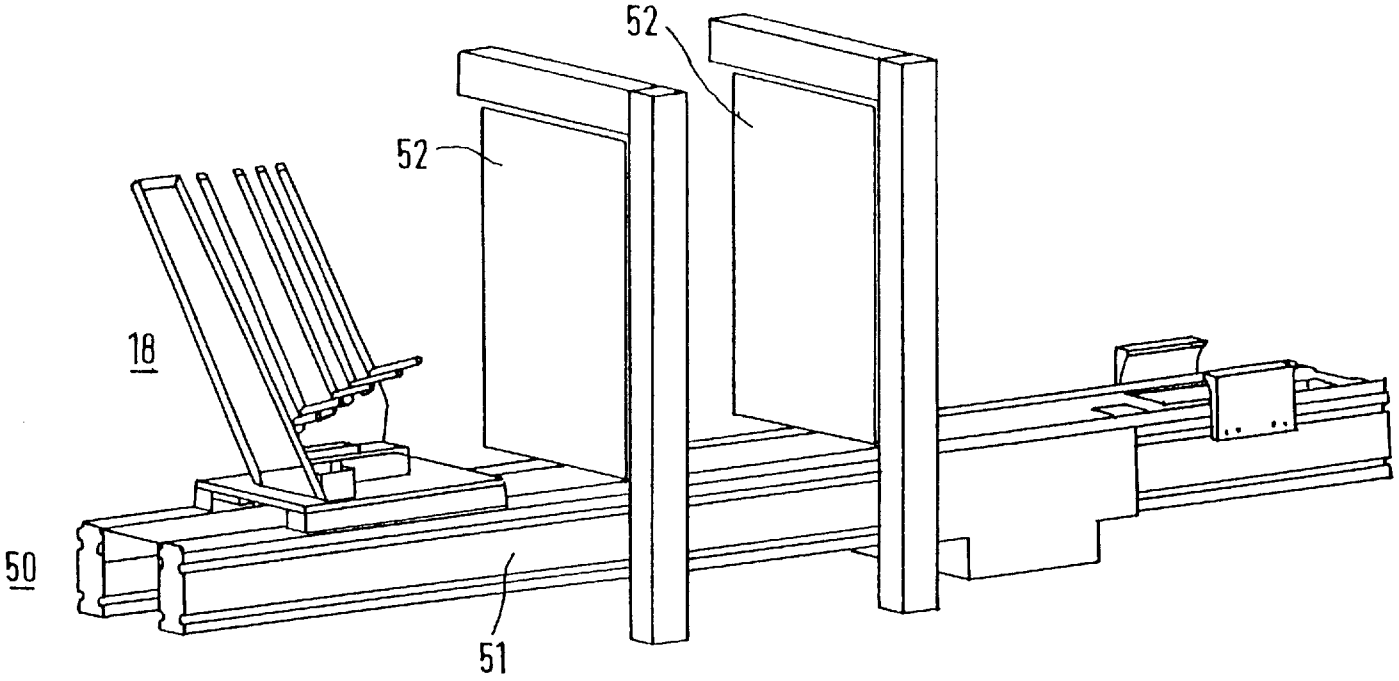

Further advantages and developments of the invention can be found in the dependent claims and in the following description with reference to the figures, in which:

FIG. 1 shows a first embodiment of an apparatus for singling sheet material, FIGS. 2*a*, 2*b* show sheet feeding means, FIGS. 3*a*, 3*b* show a further embodiment of sheet feeding means, FIGS. 4*a* to 4*f* show a method for singling loose sheet material with a singling gap, FIGS. 5*a* to 5*f* show a method for continuously singling loose sheet material, FIGS. 6*a*, 6*b* show a second embodiment of an apparatus for singling sheet material in different working positions, FIGS. 7, 7*a*, 7*b* show further embodiments of sheet feeding means, FIG. 8 shows a transport system with an input pocket.

FIG. 1 shows a schematized side view of an inventive apparatus for singling loose sheet material, in particular bank notes. The apparatus includes substantially input pocket 10 for the sheet material present in the form of stacks 1, 2 within the input pocket and vertically and horizontally movable means 20 for feeding the sheet material to device 30 which singles the sheet material out of the input pocket and feeds it to transport device 35 leading further. Input pocket 10 includes vertically adjustable rest 11 for stack 2 located in the feed position, guide rods 12 and retaining wall 15 which are fastened by suitable fixing means 13, 14. Means 20 and bank-note stack 1 disposed thereon are shown here in the singling position. However means 20 can be moved out of the singling position between guide rods 12 laterally, i.e. horizontally, out of the input pocket in order to be moved outside the input pocket to a position defined below rest 11 for feeding stack 2.

FIG. 2*a* shows a plan view of means 20 from FIG. 1 in the moved-out position outside input pocket 10. Means 20 include a rakelike gripper and—not shown for clarity's sake—a guide rod assembly along with a drive for vertical and horizontal motion of the gripper. The gripper includes a plurality of rods 21 fastened to frame 22. At least the rod adjacent retaining wall 16 of the input pocket has projection 23 which serves to prevent a sheet from sliding through between retaining wall 15 and projection 23 of the gripper when the latter has moved into the input pocket, as shown in FIG. 2*b*.

FIGS. 3*a* and 3*b* show plan views of a further embodiment of means 20, wherein at least one rod has over its entire length teeth 24 adapted to mesh with retaining wall 16, as shown in FIG. 3*b*. For the toothed rod to be able to move in and out of the input pocket, the rod is disposed rotatably on frame 22. One can also give several or all of rods 21 of the gripper a rotatable and toothed design, thereby obtaining a partly or completely closed supporting surface of the gripper.

FIGS. 4*a* to 4*f* show the function course for singling loose sheet material with one gripper. FIG. 4*a* shows gripper 20 in the feed position below rest 11 on which bank-note stack 1 is disposed. FIG. 4*b* shows gripper 20 as it is being moved through rest 11 vertically to the singling position, which is shown in FIG. 4*c*. In FIG. 4*d* next stack 2 is already located in the feed position in the input pocket. When the stack located in the singling position has been singled, the gripper is moved horizontally out of the input pocket and vertically down to below the rest, as shown in FIGS. 4*e* and 4*f*.

FIGS. 5*a* to 5*f* show the function course for singling loose sheet material using two grippers. FIG. 5*a* shows first gripper 20 in its feed position and second gripper 40 in the upper position moved out of the input pocket. FIG. 5*b* shows first gripper 20 in the singling position and second gripper 40 in the lower moved-out position. FIG. 5*c* shows upper gripper 20 during the singling of stack 1 and lower gripper 40 in its feed position below rest 11. FIG. 5*d* shows lower gripper 40 being moved through the rest vertically upward, whereby stack 2 is brought together with the sheets of stack 1 yet to be singled. FIG. 5*e* shows next stack 3 already being disposed on rest 11 in the input pocket and gripper 20 being moved out of the input pocket. Gripper 20 is then lowered vertically down to below the rest and then moved into the input pocket to its feed position while stack 2 is still being singled. The run continues with FIG. 5*c*.

FIG. 6*a* shows a perspective view of a further embodiment of an apparatus for singling loose sheet material. Means 20, 40 for feeding the sheet material likewise include rakelike grippers, upper gripper 20 being located in the singling position and lower gripper 40 below rest 11 of input pocket 10 in the feed position. For clarity's sake the guide rod assembly and the drive means for vertical and horizontal motion of the grippers have been left out. Input pocket 10 has rest 11, guide rods 12 and retaining wall 15 which are each fastened by fixing means 13 and 14. As apparent from FIG. 6*a*, input pocket 10 is inclined to the horizontal plane in two planes in such a way as to guarantee reliable transport of the sheet material.

In contrast to the first embodiment the input pocket consists of two separable parts, guide rods 12 and retaining wall 15 of input pocket 10 being interconnected in separable fashion. Upper part 17 is stationary on fixing means 14 whereas lower part 18 of the input pocket is of transportable design. Transportable lower part 18 of the input pocket is provided with mechanically operable flag 19 which serves to mark last input pocket 18 of an accounting unit. The last sheet of the accounting unit can then be recognized by means of reflected light barrier 34.

FIG. 6*b* shows the same apparatus whereby lower gripper 40 is bringing stack 2 disposed thereon together with stack 1 being singled, and upper gripper 20 is being moved horizontally and laterally out of the input pocket.

FIG. 7 shows sheet feeding means 20 as are used for example in the apparatus according to FIGS. 6*a*, 6*b*. Means 20 are identical with means 40 in FIGS. 6*a*, 6*b* and include a rakelike gripper with frame 22 and prongs 21 fastened thereto, at least one prong having projection 23 which has the same function as the projection shown in FIG. 2*a*. The rakelike gripper is fastened to rotatable lever arm 25 which is in turn disposed on guide plate 28. The gripper can be moved horizontally, on the one hand, and vertically, on the other hand, as shown e.g. in FIGS. 6*a* and 6*b*, via rods 29 by drive means (not shown).

For controlling the motion pattern of the grippers one provides suitable microswitches 26 and 27 which detect the rotation caused by the feed of the lower gripper on the gripper located in the upper singling position. Upon sufficient rotation of the upper gripper microswitch 26 is then opened and microswitch 27 closed. The electromechanical operation of the switches due to the rotation causes the feed motion of the lower gripper to be stopped by a control unit (not shown) and the upper gripper to be moved out of the input pocket, as shown in FIG. 6*b*.

FIG. 7*a* shows a further embodiment of sheet feeding means 60 as can be used e.g. in the apparatus according to FIGS. 6*a*, 6*b*. Means 60 likewise include a vertically and horizontally movable rakelike gripper with a plurality of prongs 61 fastened to frame 62. In contrast to the embodiment shown in FIG. 7, the rakelike gripper is connected rigidly via lever arm 65 with the guide plate not shown here. At least one prong 61 of the rakelike gripper has a slot for receiving mechanical fingerlike feeler 64 subjected to a spring force. Feeler 64 is movable within the slot, the motion being detected by a sensor, e.g. inductive proximity switch 66.

FIG. 7*b* shows a sectional view along line A—A of prong 61 with the slot and feeler 64. The latter is fastened rotatably to frame 62 and held by springs 67 in the singling position shown here. The feed motion of the lower gripper (not shown here for clarity's sake) causes the sheet material located thereon to come in contact with feeler 64, thereby moving feeler 64 out of the singling position toward prong 61. The electromechanical operation of switch 66 due to the rotation of the feeler then causes the feed motion to stop. Since in this embodiment only feeler 64 and not the entire rakelike gripper is moved, the feed motion can be controlled more exactly and more quickly due to the lower inertia of masses. Also, the rakelike gripper is of simpler construction and thus less susceptible to wear in this embodiment.

FIG. 8 shows transport system 50 with path 51 for transporting lower parts 18 from a loading unit to a singler (not shown). At the loading unit lower parts 18 are filled with sheet material and then transported to the singler, whereby lower part 18 can be connected with the upper part of the input pocket (not shown here), as shown in FIG. 6*a*. Lower parts 18 can be filled with sheet material manually or automatically e.g. with the help of robots. For noise reduction one provides movable flaps 52 which acoustically decouple the transport path from the singler. A plurality of such lower parts can be arranged in tandem in the transport path so that the transport path fulfills a storage function.

One can of course also provide a plurality of such transport paths for supplying a plurality of singlers with sheet material automatically. The transport, filling and emptying of the input pockets can thereby be controlled fully automatically by a central master computer (not shown).

We claim:

1. A method for singling loose sheet material such as bank notes, comprising the steps of:

using a first feeding mechanism to supply sheet material in the form of a first stack in an input pocket in a defined position for vertical feed of the sheet material to a singler;

using the first feeding mechanism to vertically move the first stack within the input pocket from the defined position to a singling position in which the sheet material is singled;

supplying a second stack of sheet material in the input pocket in the defined position and using a second feeding mechanism to move the second stack vertically within the input pocket to bring the second stack contiguous with the first stack while the first stack is still being singled;

moving the first feeding mechanism in a substantially horizontal direction out from between the first and second stacks at only one side of the stacks and subsequently moving the first feeding mechanism into a position below the second feeding mechanism and below the defined position; and continuing to vertically sequentially move the stacks to the singling position using the feeding mechanisms, resulting in a continuous and uninterrupted feed of stacked sheet material to a singler.

2. The method according to claim 1, further comprising the steps of:

combining a plurality of stacks into one accounting unit;

distributing the plurality of stacks over a plurality of lower parts and combining them with an upper part to form the input pocket; and automatically sensing a last lower part corresponding to a last input pocket of the accounting unit by sensing a mechanical flag attached to the last lower part.

3. The method according to claim 2, further comprising the step of:

automatically sensing feeding of a last sheet of the sheet material of the accounting unit by sensing a reflected light barrier associated with the accounting unit and that is exposed to sensing upon feeding of the said last sheet.

4. The method according to claim 1, further comprising the steps of:

filling a plurality of lower parts; combining each lower part with an upper part to form said input pocket with the sheet material located at a loading position; and transporting each lower part to at least one singler.

5. The method according to claim 4, including filling of the lower parts with the sheet material automatically and controlling the filling and transporting of the lower parts from a central control station.

6. An apparatus for singling loose sheet material, in particular bank notes, comprising:

an input pocket for sheet material supplied in the form of a stack;

a rest disposed on a lower part of said input pocket on which said sheet material is supplied;

a singling device located adjacent said input pocket at a singling position above said rest, said singling device arranged to single said sheet material sheet-by-sheet out of said input pocket; and a first feeding mechanism and a second feeding mechanism located on one side of said input pocket which are arranged to move vertically and horizontally so as to alternately feed stacks of said sheet material on said rest vertically to said singling device, wherein said feeding mechanisms include devices that cooperate with said input pocket such that said feeding mechanisms are alternately movable into said input pocket from said one side at a feed position below said rest, vertically through said rest to said singling position, laterally out of said input pocket at said one side, and outside said input pocket along said one side to a position below said other feeding mechanism and below said rest.

7. An apparatus for singling loose sheet material according to claim 6, wherein said feeding mechanisms comprise two rake-like grippers which are movable vertically and horizontally relative to said input pocket so as to continuously feed said sheet material to said singling device.

8. An apparatus for singling loose sheet material according to claim 7, wherein each of said grippers is rotatably mounted and each includes at least one switch which is arranged so as to electro-mechanically control movement of said grippers such that movement of one of said grippers from said feed position towards said singling position actuates said switch of the other one of said grippers located at the singling position such that movement of said one of said grippers towards said singling position is stopped and said other one of said grippers is moved horizontally out of said input pocket.

9. An apparatus for singling loose sheet material according to claim 8, wherein said switches are microswitches which detect rotation of each respective gripper.

10. An apparatus for singling loose sheet material according to claim 7, wherein said input pocket includes a retaining wall, and each of said rake-like grippers has at least one side protruding area which cooperates with said retaining wall such that a sheet of said sheet material is prevented from sliding between said retaining wall and said side protruding area.

11. An apparatus for singling loose sheet material according to claim 10, wherein said side protruding areas are rotatable relative to said respective gripper.

12. An apparatus for singling loose sheet material according to claim 11, wherein each of said rake-like grippers has a plurality of inner protruding areas which are rotatable relative to said respective gripper whereby a closed supporting surface of said respective gripper may be obtained.

13. An apparatus for singling loose sheet material according to claim 7, wherein each of said rake-like grippers has a mechanical feeler which electro-mechanically senses movement of said grippers in such a way that one of said grippers moving from said feed position towards said singling position actuates said mechanical feeler of the other one of said grippers located at said singling position such that movement of said one of said grippers towards said singling position is stopped and said other one of said grippers is moved horizontally out of said input pocket.

14. An apparatus for singling loose sheet material according to claim 13, wherein said mechanical feelers are rotatable finger-like elements and each of said rake-like grippers has an inductive proximity switch which detects rotation of each respective mechanical feeler.

15. An apparatus for singling loose sheet material according to claim 6, further comprising: at least one sidewall of said input pocket which is defined by parallel vertical rods; and wherein said rest is also defined by parallel vertical rods.

16. An apparatus for singling loose sheet material according to claim 15, including a device for vertically adjusting said rest of said input pocket.

17. An apparatus for singling loose sheet material according to claim 15, wherein said input pocket comprises an upper part which is stationary in said apparatus and a lower part which is transportable outside said apparatus, said upper and lower parts adapted to be brought together to form said input pocket.

* * * * *